US007135818B2

(12) United States Patent
Min

(10) Patent No.: US 7,135,818 B2
(45) Date of Patent: Nov. 14, 2006

(54) PLASMA DISPLAY PANEL WITH SQUARE CELLS

(75) Inventor: Byoung Kuk Min, Seoul (KR)

(73) Assignee: LG Electronics Inc., Seoul (KR)

( * ) Notice: Subject to any disclaimer, the term of this patent is extended or adjusted under 35 U.S.C. 154(b) by 61 days.

(21) Appl. No.: 10/946,353

(22) Filed: Sep. 22, 2004

(65) Prior Publication Data

US 2005/0067960 A1 Mar. 31, 2005

(30) Foreign Application Priority Data

Sep. 25, 2003 (KR) ..... 10-2003-0066612

(51) Int. Cl.
*H01J 17/49* (2006.01)

(52) U.S. Cl. ..... 313/582; 313/587; 313/586

(58) Field of Classification Search ..... 313/582, 313/587; 315/169.1, 169; 345/41, 60, 65, 345/72

See application file for complete search history.

(56) References Cited

U.S. PATENT DOCUMENTS

2005/0029916 A1* 2/2005 Moon ..... 313/311

* cited by examiner

*Primary Examiner*—Nimeshkumar D. Patel
*Assistant Examiner*—Natalie K. Walford
(74) *Attorney, Agent, or Firm*—Fleshner & Kim, LLP

(57) ABSTRACT

The present invention relates to a plasma display panel, and more particularly, to a cell structure of a plasma display panel. In a plasma display panel in which square cells constitute a delta type barrier rib structure, a red cell and a green cell are alternately formed in a first horizontal cell line of the cells, a blue cell is located at the lower center between the red cell and the green cell in a second horizontal cell line of the cells, the blue cell is alternately formed together with a blank cell, and the first horizontal cell line and the second horizontal cell line are alternately formed in the vertical direction. Accordingly, brightness, efficiency and the contrast ratio are improved and high-speed driving is accomplished.

8 Claims, 8 Drawing Sheets

REPLACEMENT SHEET

PLASMA DISPLAY PANEL WITH SQUARE CELLS

This Nonprovisional application claims priority under 35 U.S.C. § 119(a) on Patent Application No. 10-2003-066612 filed in Korea on Sep. 25, 2003, the entire contents of which are hereby incorporated by reference.

BACKGROUND OF THE INVENTION

1. Field of the Invention

The present invention relates to a plasma display panel, and more particularly, to the cell structure of a plasma display panel.

2. Description of the Background Art

FIG. 1 illustrates a stripe type barrier rib structure of a conventional plasma display panel. FIG. 2 illustrates a well type barrier rib structure of a conventional plasma display panel.

The stripe type structure shown in FIG. 1 has a good discharge characteristic, but has a disadvantage that the phosphor covering area is small. The well type structure shown in FIG. 2 has high brightness since the covering area of phosphors is wide, but has a problem that the discharge characteristic is bad.

FIG. 3 illustrates a delta type barrier rib structure of a conventional plasma display panel.

Referring to FIG. 3, in the delta type barrier rib structure, one cell is surrounded by 6 faces. Thus, the covering area of phosphors is increased and brightness is improved due to increased reflectivity of barrier walls. Each color is connected to a narrow channel whereby discharge or injection of a gas is smooth. Further, as a discharge start voltage in the narrow channel is higher than that of a wide channel, there is an advantage in that crosstalk in the barrier rib direction can be prevented. Moreover, brightness and efficiency can be improved even without additional process because the method for fabricating and operating the barrier ribs is the same as a prior art FIG. 4 illustrates a square type barrier rib structure of a Conventional plasma display panel.

The barrier rib structure shown in FIG. 4 has the same structure as the barrier rib structure of FIG. 3 except that the cell shape is square. In the square barrier rib structure of FIG. 4, red, green and blue cells form a triangle similar to the delta type barrier rib structure and thus constitute one cell. The square barrier rib structure of FIG. 4 is the same as the delta type barrier rib structure of FIG. 3 in that brightness and efficiency are increased due to increase in the aperture ratio and the phosphor covering area.

However, in the barrier rib structure of FIG. 3 and FIG. 4, the cells are extended sideward lengthily. Therefore, upon implementation of a still image, the still image is not implemented smoothly diagonally. Thus, there is a problem in that the picture quality is degraded.

SUMMARY OF THE INVENTION

Accordingly, an object of the present invention is to solve at least the problems and disadvantages of the background art.

An object of the present invention is to provide a plasma display panel in which brightness and efficiency are improved and the contrast ratio is improved compared to an existing delta structure.

To achieve the above object, according to a first embodiment of the present invention, there is provided a plasma display panel in which square cells constitute a delta type barrier rib structure, wherein a red cell and a green cell are alternately formed in a first horizontal cell line of the cells, a blue cell is located at the lower center between the red cell and the green cell in a second horizontal cell line of the cells, the blue cell is alternately formed together with a blank cell, and the first horizontal cell line and the second horizontal cell line are alternately formed in the vertical direction.

According to a second embodiment of the present invention, there is provided a plasma display panel in which square cells constitute a delta type barrier rib structure, wherein a red cell and a green cell are alternately formed in a first horizontal cell line of the cells, a blue cell is located at the lower center between the red cell and the green cell in a second horizontal cell line of the cells, the blue cell is alternately formed together with a black cell, and the first horizontal cell line and the second horizontal cell line are alternately formed in the vertical direction.

According to the present invention, brightness, efficiency and the contrast ratio are improved and high-speed driving is accomplished.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

First Embodiment

According to a first embodiment of the present invention, there is provided a plasma display panel in which square cells constitute a delta type barrier rib structure, wherein a red cell and a green cell are alternately formed in a first horizontal cell line of the cells, a blue cell is located at the lower center between the red cell and the green cell in a second horizontal cell line of the cells, the blue cell is alternately formed together with a blink cell, and the first horizontal cell line and the second horizontal cell line are alternately formed in the vertical direction.

The red cell, the green cell and the blue cell constitute one picture element in an inverted triangle shape, and the picture element is parallel to the direction vertical to the horizontal direction.

Transparent electrodes are formed on the cells in the horizontal direction, bus electrodes are formed at the bottom of the transparent electrodes, and data electrodes are formed on the vertical line of the red cell and the green cell, and the blue cell.

A data electrode is further disposed on the vertical line of the blank cell.

Hereafter, the first embodiment of the present invention will be described in a more detailed manner with reference to the drawings.

Figure 5:
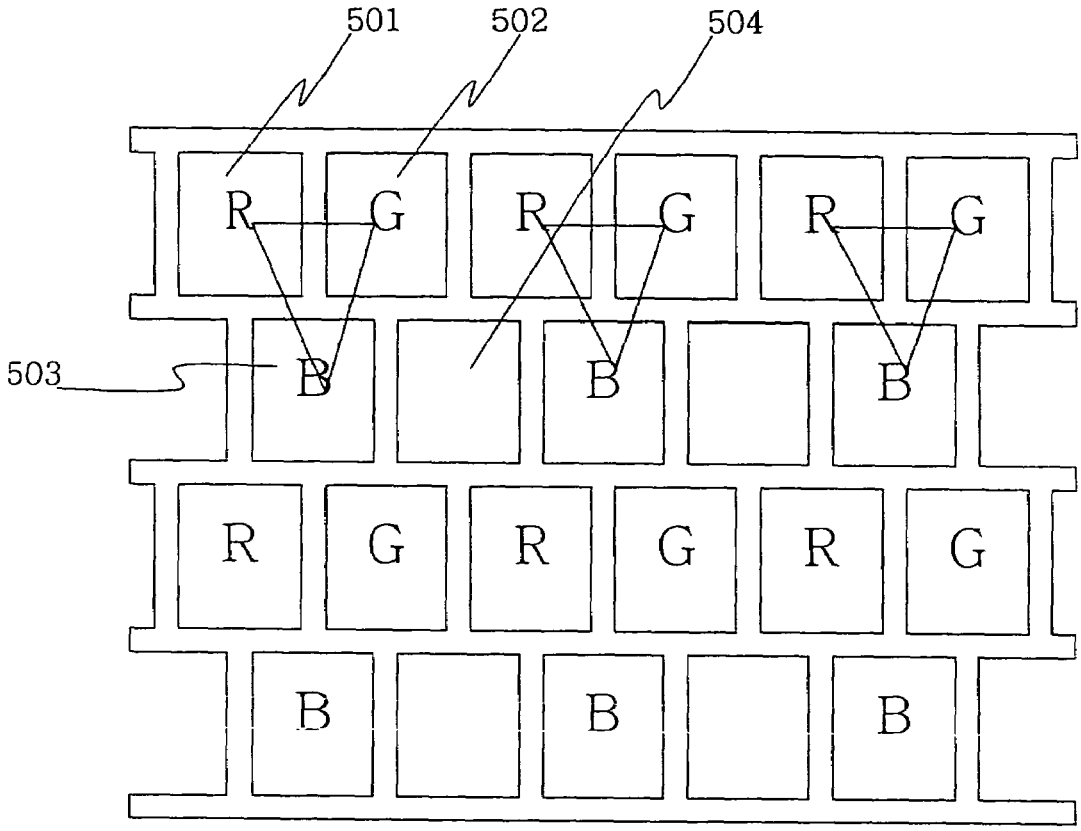
FIG. 5 illustrates a cell structure of a plasma display panel according to a first embodiment of the present invention.

FIG. 5 illustrates a cell structure of a plasma display panel according to a first embodiment of the present invention. In FIG. 5, there is shown a state where red cells 501, green cells 502 and blue cells 503 are arranged.

Figure 1:
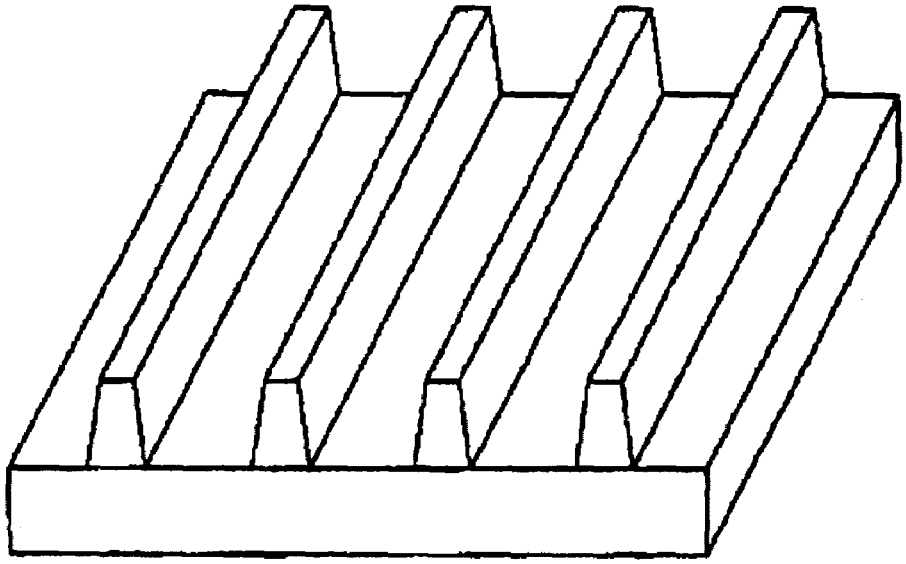
Related Art Fig. 1
FIG. 1 illustrates a stripe type barrier rib structure of a (conventional plasma display panel.
Figure 2:
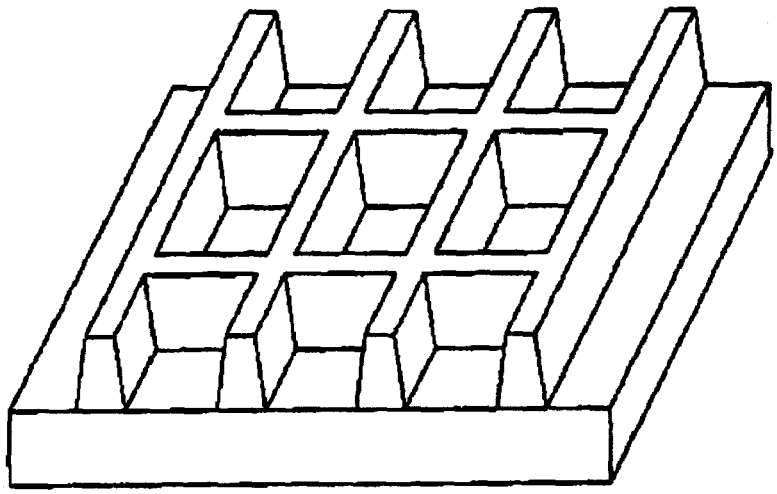
Related Art Fig. 2
FIG. 2 illustrates a well type barrier rib structure of a conventional plasma display panel.
Figure 3:
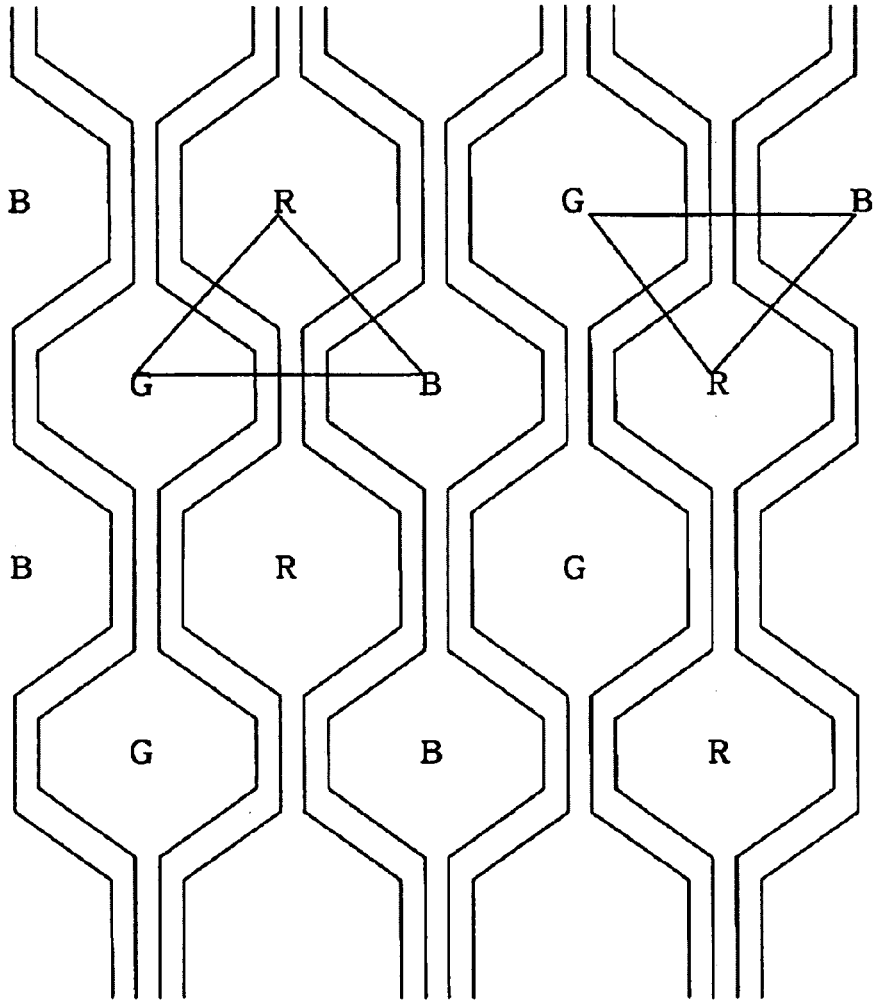
Related Art Fig. 3
FIG. 3 illustrates a delta type barrier rib structure of a conventional plasma display panel.
Figure 4:
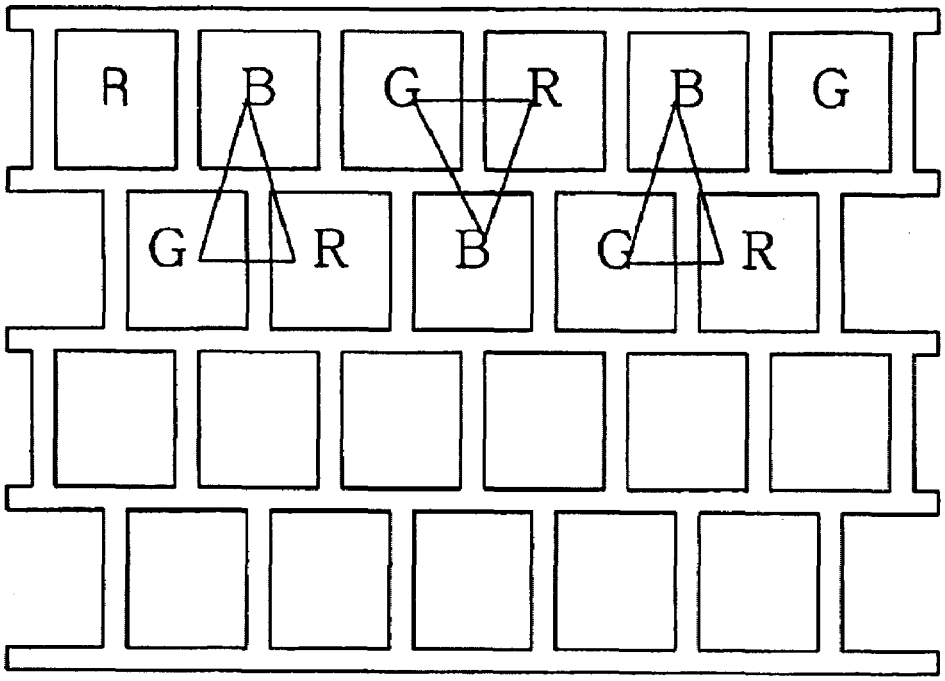
Related Art Fig. 4
FIG. 4 illustrates a square type barrier rib structure of a conventional plasma display panel.

As shown in FIG. 5, in the plasma display panel according to the first embodiment of the present invention, the cells are arranged continuously in an inverted triangle shape unlike the structure of FIG. 4 in which the cells are arranged in the regular triangle shape and the inverted triangle shape alternately. That is, in a first horizontal cell line, the red cell 501 and the green cell 502 are alternately formed. In a second horizontal cell line, the blue cell 503 is disposed at the lower center between the red cell 501 and the green cell 502 of the first line, and the blue cell 503 and a cell on which phosphors are not coated (hereinafter, referred to as 'blank cell 504') are alternately formed. The first line and the second line are alternately formed in the vertical direction.

In the cell lines alternately formed, the red cell 501, the green cell 502 and the blue cell 503 constitute one picture element in the form of the inverted triangle. In the case where the cells are arranged in the regular triangle shape and the inverted triangle shape alternately as shown in FIG. 4, it is difficult to exactly implement a diagonally straight line or a pattern such as a character. If the cells are continuously arranged in the inverted triangle shape, it is possible to implement the same picture quality as the stripe cell.

Compared with the structure of FIG. 4, one of four pixels in the structure of FIG. 5 has no phosphors and thus remains empty. Accordingly, brightness of the structure shown in FIG. 5 is reduced to about ¼ of the structure of FIG. 4. However, power consumption can be reduced because electrodes are not disposed in empty pixels. Thus, efficiency is not reduced. Furthermore, brightness of the structure shown in FIG. 5 is lower than that of the structure shown in FIG. 4. However, the aperture ratio and the phosphor coefficient of utilization of phosphors are increased compared to the stripe structure. Therefore, the whole efficiency of the structure shown in FIG. 5 is increased.

In other words, the shape of the pixels is close to the regular square. Thus, brightness and efficiency are improved since the aperture ratio of the cell is increased.

Figure 6:
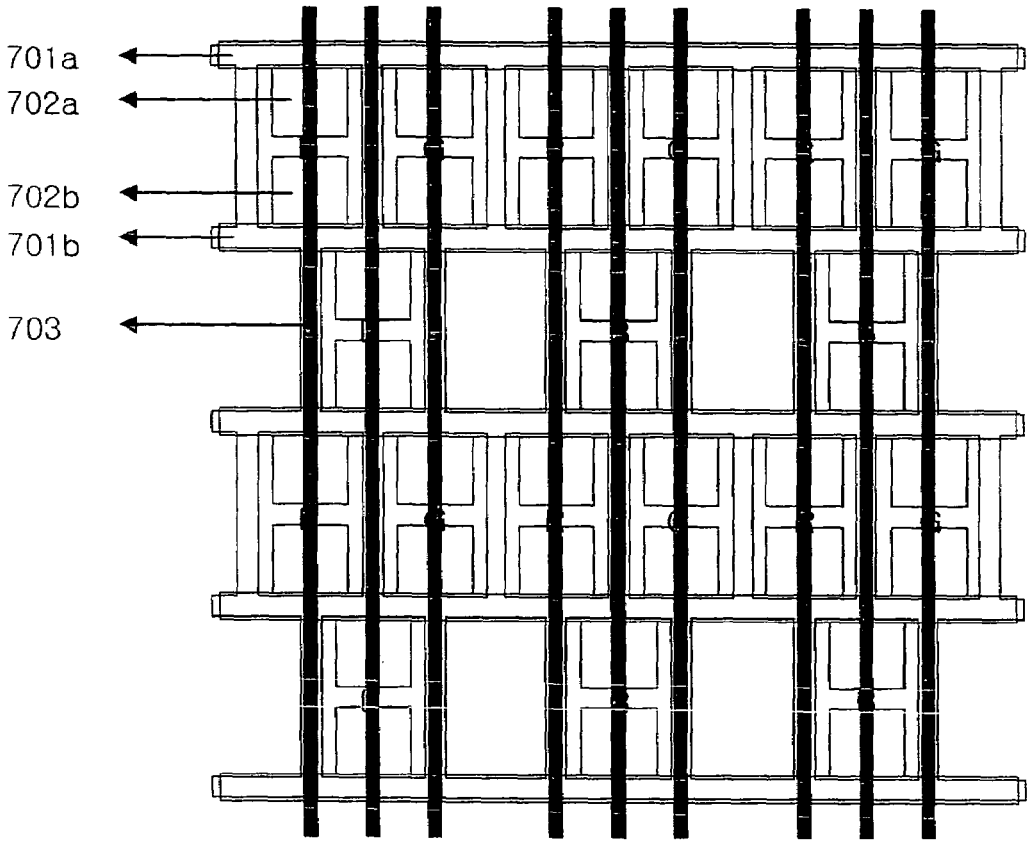
FIG. 6 shows a structure in which electrodes of a plasma display panel are arranged according to a first embodiment of the present invention.

FIG. 6 shows a structure in which electrodes of a plasma display panel are arranged according to a first embodiment of the present invention.

Referring to FIG. 6, the plasma display panel according to the first embodiment of the present invention includes a first ITO electrode 702*a*, a second ITO electrode 702*b*, a first bus electrode 701*a*, a second bus electrode 701*b* and a data electrode 703. Further, the first ITO electrode 702*a* and the second ITO electrode 702*b* are formed along the horizontal barrier ribs of the cell. A first bus electrode 701*a* and a second bus electrode 702*b* for compensating for high resistance of ITO are formed at the edges of the first ITO electrode 702*a* and the second ITO electrode 702*b*.

The data electrode 703 is formed along the vertical line of the cell. The data electrode 703 is formed only on the vertical lines of the red cell 501 and the green cell 502 and on the vertical line of the blue cell 503. That is, the data electrode 703 is removed in the blank cell 504 (this is the same even in the black cell 601) in order to avoid unnecessary power consumption.

Figure 7:
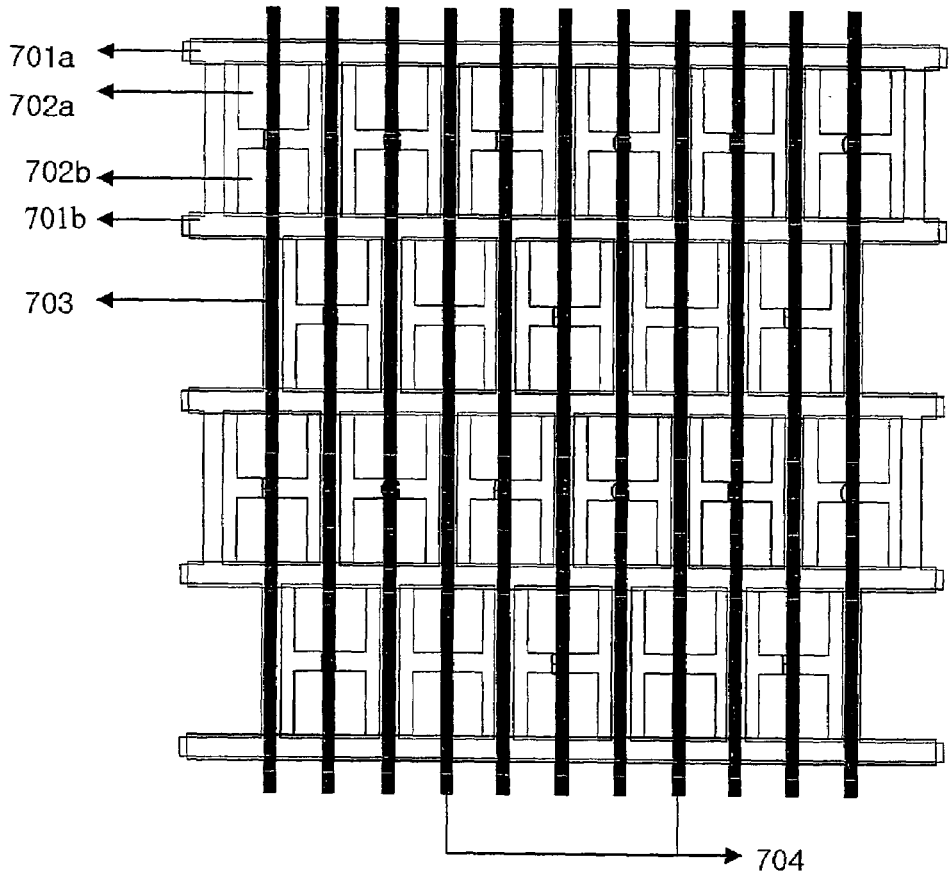
FIG. 7 shows another structure in which electrodes of a plasma display panel are arranged according to a first embodiment of the present invention.

FIG. 7 shows another structure in which electrodes of a plasma display panel are arranged according to a first embodiment of the present invention.

As shown in FIG. 7, the arrangement of electrodes in FIG. 7 is similar to those of FIG. 7. Like other cells, a first ITO electrode 702*a*, a second ITO electrode 702*b*, a first bus electrode 701*a*, a second bus electrode 701*b* and a blank cell data electrode 704 are disposed even in the blank cell (or the black cell). This is for accomplishing high-speed driving by supplying priming molecule to neighboring cells in such a way that data pulse is always applied to the data electrode 704 of the blank cell (or the black cell) in order to generate address discharging. In this case, although power consumption is the same as the existing delta structure, brightness and efficiency are disadvantageous because brightness is reduced by 25%. However, the amount of reduction of brightness can be compensated through use of high Xe. It is also possible to maintain brightness and efficiency much better than that of the stripe structure.

<2실시예>

According to a second embodiment of the present invention, there is provided a plasma display panel in which square cells constitute a delta type barrier rib structure, wherein a red cell and a green cell are alternately formed in a first horizontal cell line of the cells, a blue cell is located at the lower center between the red cell and the green cell in a second horizontal cell line of the cells, the blue cell is alternately formed together with a black cell, and the first horizontal cell line and the second horizontal cell line are alternately formed in the vertical direction.

The red cell, the green cell and the blue cell constitute one picture element in an inverted triangle shape, and the picture element is parallel to the direction vertical to the horizontal direction.

Transparent electrodes are formed on the cells in the horizontal direction, bus electrodes are formed at the edges of the transparent electrodes, and data electrodes are formed on the vertical line of the red cell and the green cells and the blue cell.

A data electrode is further disposed on the vertical line of the black cell.

Hereafter, the second embodiment of the present invention will be described in a more detailed manner with reference to the drawings.

Figure 8:
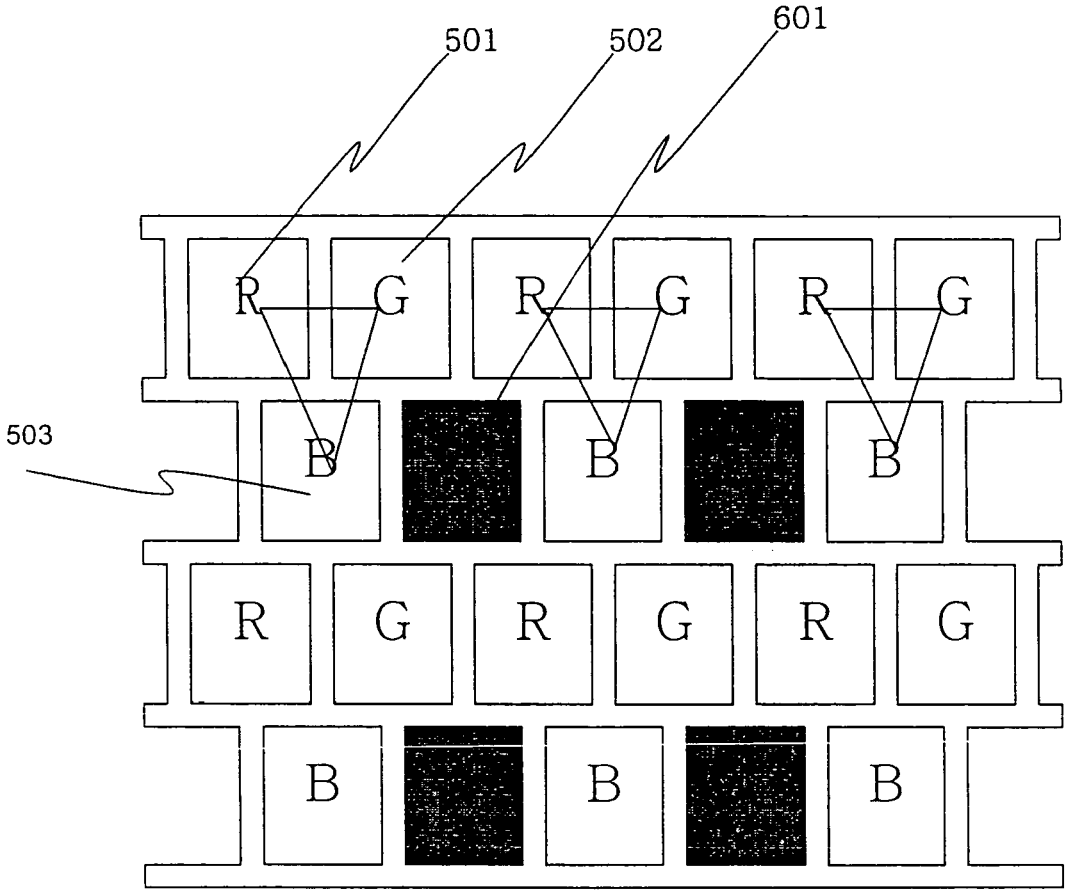
FIG. 8 shows a cell structure of a plasma display panel according to a second embodiment of the present invention.

FIG. 8 shows a cell structure of a plasma display panel according to a second embodiment of the present invention.

As shown in FIG. 8, the cell structure of the second embodiment is almost the same as the cell structure of the first embodiment except that it includes a black cell 601 instead of the blank cell. If the blank cell 504 is replaced with the black cell 601 as above, reflectivity of external light can be reduced by 25%. It is thus possible to increase the contrast ratio although a white barrier rib material is used.

Furthermore, even the second embodiment can have the electrode arrangement of FIG. 6 and FIG. 7 like the first embodiment. This leads to the same effect as the first embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel in which square cells constitute a delta type barrier rib structure, wherein a red cell and a green cell are alternately formed in a first horizontal cell line of the cells, a blue cell is located at the lower center between the red cell and the green cell in a second horizontal cell line of the cells, the blue cell is alternately formed together with a blank cell, and the first horizontal cell line and the second horizontal cell line are alternately formed in the vertical direction.

2. The plasma display panel as claimed in claim 1, wherein the red cell, the green cell and the blue cell constitute one picture element in an inverted triangle shape, and the picture element is parallel to the direction vertical to the horizontal direction.

3. The plasma display panel as claimed in claim 1, wherein transparent electrodes are formed on the cells in the horizontal direction, bus electrodes are formed at the bottom of the transparent electrodes, and data electrodes are formed on the vertical line of the red cell and the green cell, and the blue cell.

4. The plasma display panel as claimed in claim 3, wherein a data electrode is further disposed on the vertical line of the blank cell.

5. A plasma display panel in which square cells constitute a delta type barrier rib structure, wherein a red cell and a green cell are alternately formed in a first horizontal cell line of the cells, a blue cell is located at the lower center between the red cell and the green cell in a second horizontal cell line of the cells, the blue cell is alternately formed together with a black cell, and the first horizontal cell line and the second horizontal cell line are alternately formed in the vertical direction.

6. The plasma display panel as claimed in claim 5, wherein the red cell, the green cell and the blue cell constitute one picture element in an inverted triangle shape, and the picture element is parallel to the direction vertical to the horizontal direction.

7. The plasma display panel as claimed in claim 5, wherein transparent electrodes are formed on the cells in the horizontal direction, bus electrodes are formed at the edges of the transparent electrodes, and data electrodes are formed on the vertical line of the red cell and the green cell, and the blue cell.

8. The plasma display panel as claimed in claim 7, wherein a data electrode is further disposed on the vertical line of the black cell.

* * * * *